US005784833A

United States Patent [19]

Sponable et al.

[11] Patent Number: 5,784,833

[45] Date of Patent: Jul. 28, 1998

[54] SILDING WINDOW WITH MOTOR-DRIVEN REGULATOR

[75] Inventors: Edward Sponable, Novi; Raymond Zeller, Westland, both of Mich.

[73] Assignee: Hi-Lex Corporation, Battle Creek, Mich.

[21] Appl. No.: 696,657

[22] Filed: Aug. 14, 1996

[51] Int. Cl.[6] ..... E05F 11/48; E05F 11/53

[52] U.S. Cl. ..... 49/360; 49/123; 49/130; 49/361

[58] Field of Search ..... 49/360, 361, 362, 49/118, 123, 352, 349, 130, 380

[56] References Cited

U.S. PATENT DOCUMENTS

| | | | |
|---|---|---|---|
| 4,177,605 | 12/1979 | Cherbourg et al. | 49/98 |
| 4,793,099 | 12/1988 | Friese et al. | 49/380 |
| 4,920,698 | 5/1990 | Friese et al. | 49/362 |
| 4,970,911 | 11/1990 | Ujihara et al. | 39/352 |
| 4,991,347 | 2/1991 | Takimoto et al. | 49/40 |
| 4,995,195 | 2/1991 | Olberding et al. | 49/118 |
| 5,146,712 | 9/1992 | Hlavaty | 49/360 |
| 5,531,046 | 7/1996 | Kollar et al. | 39/360 |
| 5,542,214 | 8/1996 | Buening | 49/360 |
| 5,613,323 | 3/1997 | Buening | 49/380 |

FOREIGN PATENT DOCUMENTS

| | | | |
|---|---|---|---|
| 3345961 | 6/1985 | Germany | 49/352 |

*Primary Examiner*—Kenneth J. Dorner
*Assistant Examiner*—Curtis Cohen
*Attorney, Agent, or Firm*—Young & Basile, P.C.

[57] ABSTRACT

A motor-driven window regulator for use with a horizontally sliding window installed in the rear window opening of a pickup truck cab. The sliding window is moved between a closed position wherein it fills a gap between two fixed, outboard mounted windows and an open position wherein it slides to overlap one of the fixed leaving the gap open. The sliding window is actuated by a pair of linear actuation cables, each of which is attached to the sliding window at a first end and to a motor-driven cable drive drum at a second end. The linear actuation cables extend away from the sliding window in opposite directions parallel with the direction of sliding movement and wrap around the cable drive drum in opposite directions so that rotation of the cable drive drum in one direction places a first cable in tension to pull the sliding window toward the open position and rotation of the cable drive drum in the opposite direction tensions the second cable to pull the sliding window toward the closed position. The pull/pull cable drive configuration results in the ability to use less closely toleranced and hence less expensive drive cables, as well as a motor which is smaller, less expensive and consumes less power.

6 Claims, 4 Drawing Sheets

SILDING WINDOW WITH MOTOR-DRIVEN REGULATOR

FIELD OF THE INVENTION

The present invention relates generally to motor-driven window modules and more specifically to an electrically powered window regulator used in a sliding window assembly for installation in a vehicle such as a pick-up truck.

BACKGROUND OF THE INVENTION

The typical, mass produced pick-up truck has a rear cab window consisting of a single fixed unit of automotive safety glass. Some pick-up truck owners prefer a rear cab window that may be opened and closed by occupants of the cab, and several different replacement window units have been proposed and marketed to fill this need. The simplest of these openable window units are manually operated by occupants of the cab, and usually comprise a pair of fixed window units located outboard in the window frame and a horizontally slidable unit filling the space therebetween.

Other prior art replacement window units are power-operated, with electromechanical systems used to raise and lower a single large window unit which substantially fills the cab rear window frame, or to move a horizontally sliding unit similar to that of the manual system described above.

U.S. Pat. No. 4,793,099 discloses an example of a vertically movable window in which a motor-driven gear engages two lengths of slotted plastic tape attached to the window unit. Rotation of the gear in one direction causes the tapes to push the unit to the raised, closed position and rotation in the other direction lowers the unit. This system requires a motor substantially more powerful than is required to move a horizontally sliding window, and the tapes and guide tracks in which they travel must have precise tolerances to prevent binding.

Another prior art power window is disclosed in U.S. Pat. No. 5,146,712. In this system, a pair of horizontally sliding window units abut one another at the center of the window frame when closed, and slide away from each other to an open position wherein they overlay two fixed outboard window units.

U.S. Pat. No. 4,920,698 teaches a horizontally sliding window driven by a pinion gear which engages a rack on the bottom edge of the unit. In alternative embodiments, either a slotted plastic tape or a Bowden cable is driven by an electric motor to push the window closed and pull it open depending on the direction of motor rotation.

This push/pull operation requires that the tape or cable be manufactured to exact dimensional tolerances to minimize binding of the tape in its guide track or the cable in its conduit when under compression to push the unit closed. In the case of the cable, this need for exact tolerances results in the push/pull cable being much more expensive to produce than a cable that is only placed in tension. Since even in a closely toleranced cable binding will inevitably occur, the drive motor used in a push/pull system must be powerful enough to overcome the friction thereby caused.

Just as pushing a cable through a conduit requires more force than pulling, so does the act of pushing the window unit along its guide rails. When a pushing force is applied to the lower corner of the window it tends to tip slightly in the guide rails, and will do so to the extent permitted by the vertical clearance between the window and the rails. This form of binding also is minimized by exact dimensional tolerances, but also cannot be eliminated completely and so requires more motor power than is the case with a window that is moved in both directions by a pulling force.

SUMMARY OF THE INVENTION

The present invention provides a power-driven sliding window assembly wherein a window of an automotive vehicle is moved horizontally between an open and a closed position by a regulator mechanism comprising a cable drive system having a motor-driven cable drum, first and second cable guides disposed adjacent opposite ends of a lower guide rail in substantially coplanar alignment with the window, and first and second cable lengths having first ends connected to the window at opposite lower corners and second ends engaging the drum. The cables extend from the drum to engage their respective cable guides, and extend therefrom along paths substantially parallel with and above the lower guide rail to reach the window. The cable drive mechanism provides a very compact installation which does not intrude significantly into the interior of the vehicle, has few parts other than those normally required for a sliding window, and applies motive force to the window in a manner to minimize binding within the guide rail so that a less powerful, lower cost motor may be used.

In the preferred embodiment of the invention, the linear actuation means comprise a pair of Bowden-type cables each of which is attached at a first end to the movable window unit and at a second unit to a drive drum powered by an electric motor. The two cables extend outward in opposite directions from their points of attachment to the window unit and pass through cable guide fittings positioned along the window units path of sliding movement near the open and closed limits thereof. The two drive cables wrap around the drive drum in opposite directions such that rotation of the drum in a first direction tensions one of the cables to pull the window toward the open position, while rotation in the opposite direction tensions the other cable to pull the window toward the closed position.

According to a further feature of the invention, the motor and drive drum are enclosed in a housing to form a drive unit which may be secured to one of the window guide rails or, alternatively, may be located in some other spot within the truck cab remote from the sliding window with the drive cables routed as necessary to reach the window.

DETAILED DESCRIPTION OF THE PREFERRED EMBODIMENT

Figure 1:
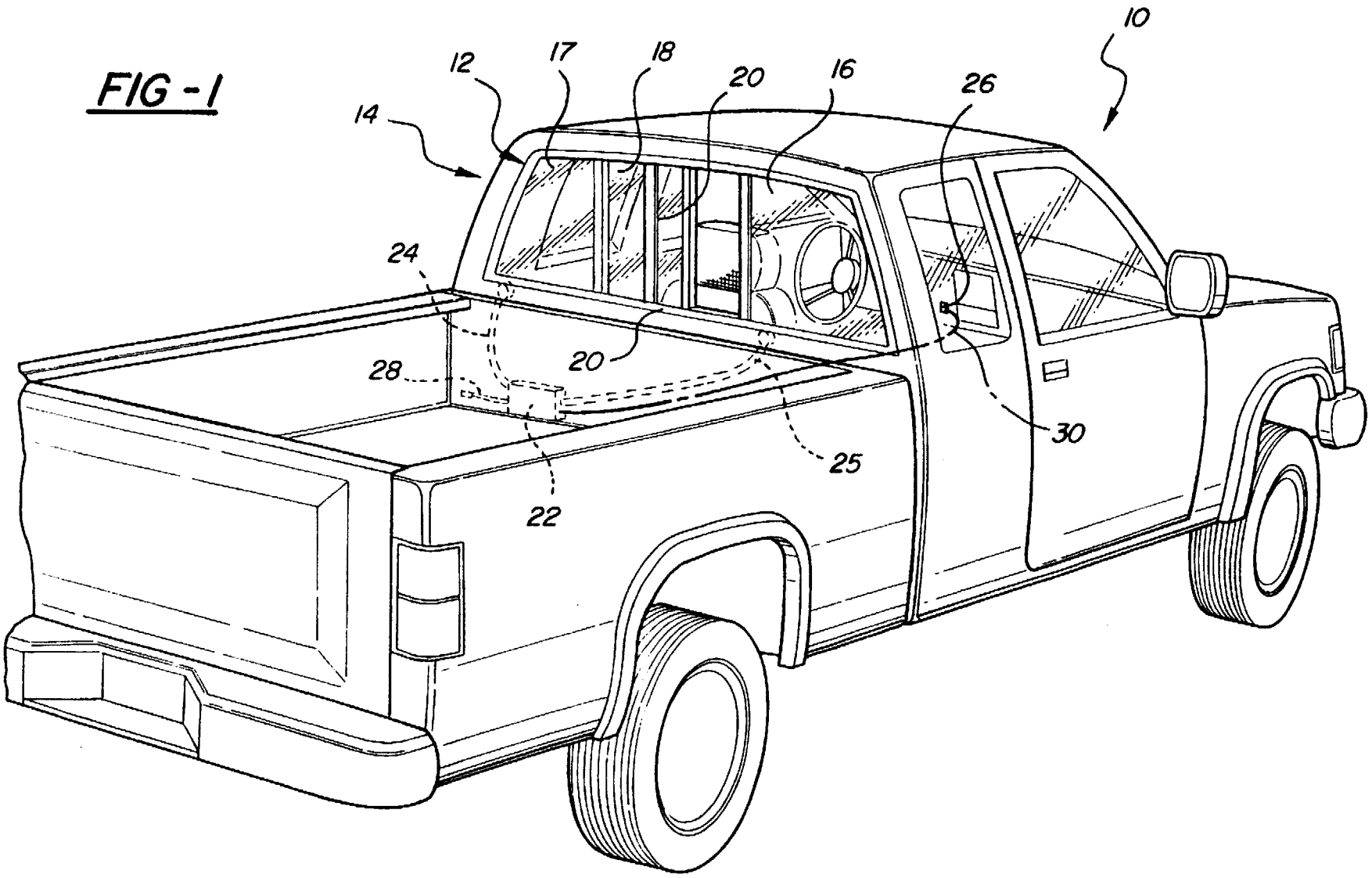
FIG. 1 is a perspective view of a pick-up truck employing a window regulator according to the present invention.

Referring to FIG. 1, a pick-up truck 10 features a powered window assembly 12 according to the present invention. Powered window assembly 12 comprises a window unit 14 installed in the rear window opening of the truck cab, a drive unit 22 located inside the truck cab, and linear actuators 24 connecting the window unit 14 with the drive unit 22.

Window unit 14 includes a substantially trapezoidal frame 15 which fits inside the cab rear window opening and supports within its outboard ends a pair of fixed windows 16, 17. Upper and lower guide rails 20, 21 run along the top and bottom portions of frame 15 on the inside of the truck cab and support a movable window unit 18 for horizontally sliding movement therealong. Window 18 comprises a pane 18*a* and left and right vertical frame members 18*b*, 18*c* attached to pane 18 by a glass adhesive. A cable attachment block 48 is fixed to each of vertical frame members 18*b*, 18*c* at the lower ends thereof.

Figure 2:
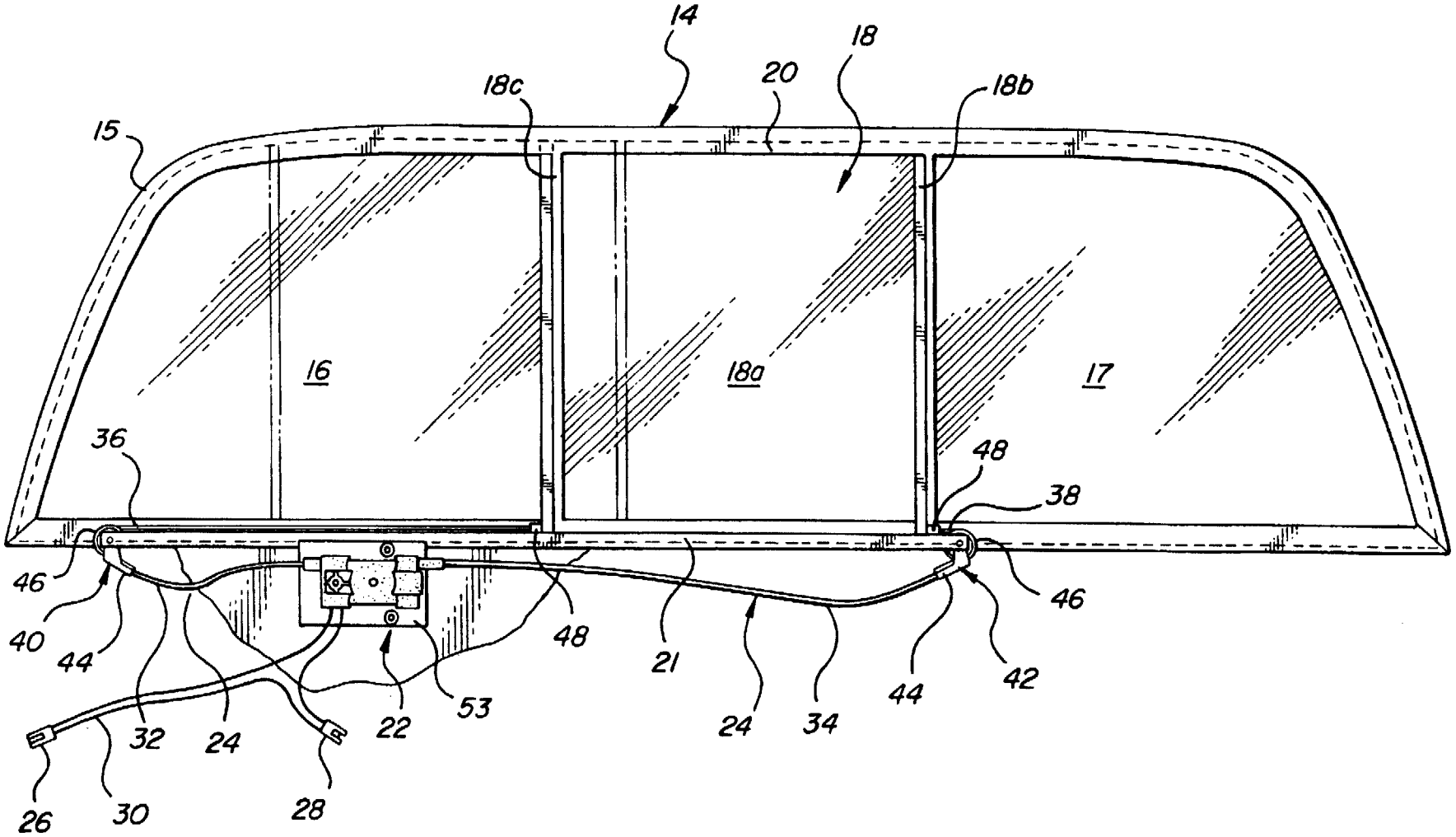
FIG. 2 is a general arrangement view showing the window regulator of the present invention in combination with a pick-up truck rear cab window assembly.
Figure 4:
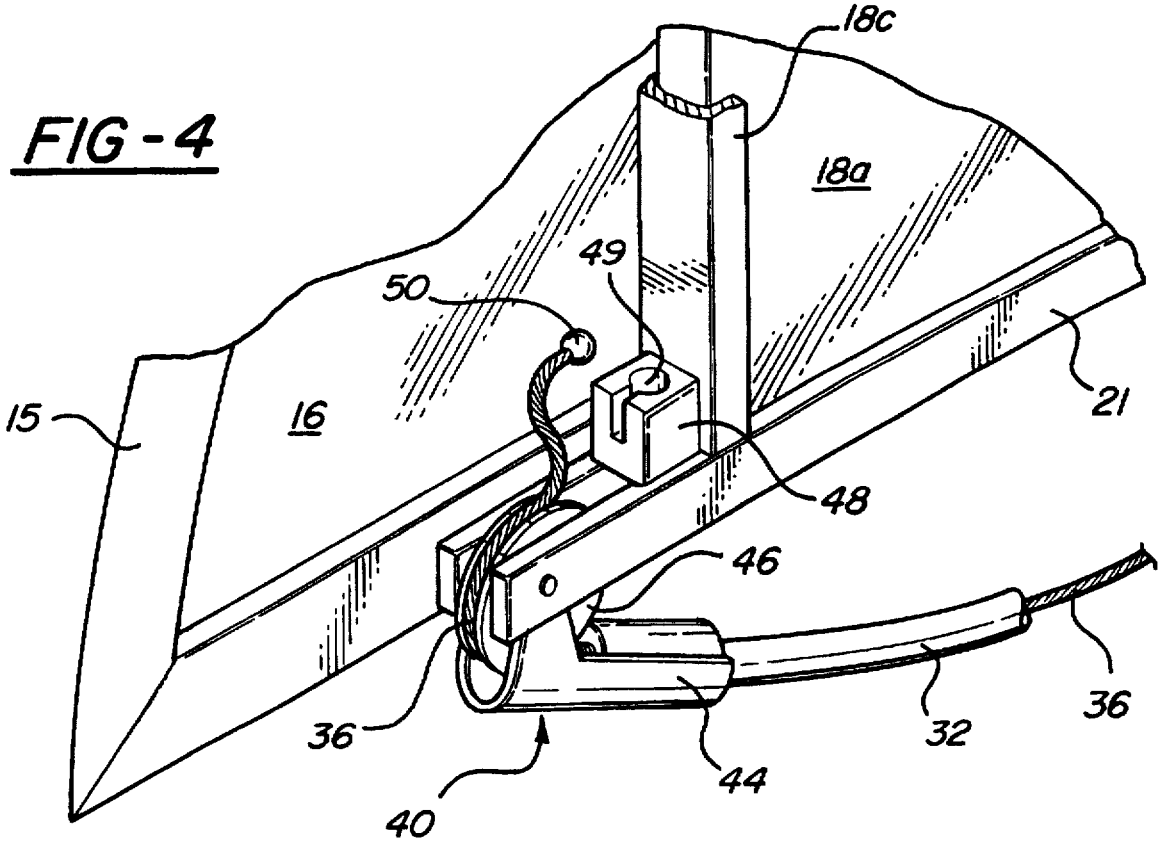
FIG. 4 is a detail view showing a cable guide fitting and guide block as used in the assembly of FIG. 2.

A pair of cable guide fittings 40, 42 are fixed to the lower portion of frame 15 in the positions shown in FIG. 2. Cable guide 40 is located near the outboard end of fixed window 16 and cable guide 42 is located near the inboard end of fixed window 17. As best seen in FIG. 4, cable guides 40,42 are positioned to be in substantially coplanar alignment with sliding window 18. Each cable guide comprises a pulley 46 and a guide tube 44.

Figure 3:
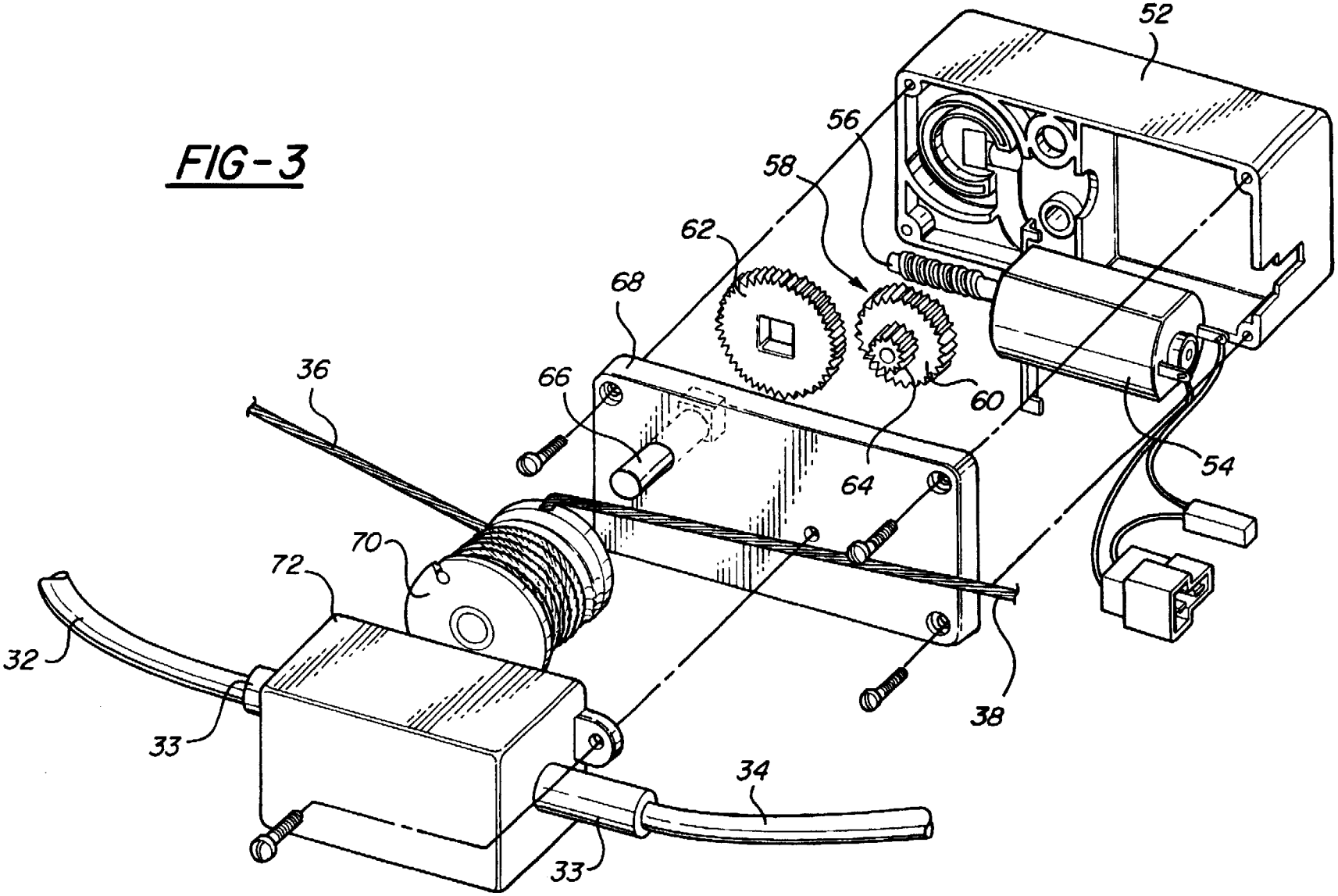
FIG. 3 is an exploded view of the drive unit of the present invention.

As best seen in FIGS. 3 and 4, linear actuators 24 are Bowden-type cables comprising outer conduits 32, 34 inside of which pass drive cables 36, 38 respectively. Each drive cable 36, 38 has a bead 50 formed at a first end thereof, and beads 50 are retained in cooperatively shaped notches 49 formed in attachment blocks 48. Drive cable 36 extends from attachment block 48 in an outboard direction toward cable guide fitting 40, passes around pulley 46 and through guide tube 44, and then through conduit 32 toward drive unit 22 where it terminates in a manner to be described below. Likewise, as seen in FIG. 2, drive cable 38 extends from its attachment block 48, passes through cable guide fitting 42 and from there extends toward drive unit 22 where it terminates.

Conduits 32, 34 are attached at their first ends to guide tubes 44 of cable guide fittings 40, 42 respectively, and at their other ends to drive unit 22.

As may best be seen in FIG. 3, drive unit 22 is comprised of a housing 52, a housing cover 68 and a drum housing 72 which enclose the working elements of the drive unit. An electric motor 54 is mounted inside housing 52 and drives a worm 56. Dual gear 58 is mounted for rotation inside housing 52 and has a worm gear portion 60 which meshes with worm 56 and a coaxial pinion portion 64 which meshes with an output gear 62. A shaft 66 is fixed to output gear 62 for rotation therewith and projects through openings in housing cover 68 to engage a cable drum 70.

Drive cables 36, 38 are attached at their second ends to cable drum 70, wrapping around the drum in opposing directions before exiting drum housing 72 and passing into conduits 32, 34. Conduits 32, 34 are resiliently connected to drum housing 72 by means of spring fittings 33 which permit a small amount of axial movement between the conduits and the drum housing. Spring fittings 33 feature an internally located coil spring to absorb shock loads applied to the system when motor 54 starts and stops. This shock absorption deceases wear and tear on the various components of drive unit 22, thereby increasing the service life of the system It is also possible to replace the two separate drive cables 36, 38 described above with a single cable having its ends attached to attachment blocks 48 and passing through both conduits 32, 34. In such an embodiment, the cable is not fixed to drum 70, but wraps around the drum several times to create a frictional engagement sufficient to prevent slippage of the cable around the drum when the cable is in tension.

Drive unit 22 may be mounted to frame 15 by means of a mounting plate 53, as shown in FIG. 2, or may alternatively be located at some other position within the track cab remote from window unit 14. In FIG. 1, for example, drive unit 22 is mounted behind the truck seat near the floor.

Motor 54 is supplied with 12 volt DC electrical power from the vehicle electrical system by means of power supply wire 28 and is controlled by a switch 26. Switch 26 is located in the truck cab in a position easily accessible to occupants thereof, for example, on the instrument panel as shown in FIG. 1, and is electrically connected with drive unit 22 by a control wire 30.

Regulator Operation

When sliding window 18 is in the fully closed position, as shown in solid lines in FIG. 2, drive cable 38 is wound around cable drum 70 several turns while drive cable 36 is fully unwound and extended. When a vehicle occupant actuates window switch 26 to open the window, motor 54 is energized and through its associated gear train drives cable drum 70 in a counterclockwise direction as viewed in FIG. 2. This counterclockwise rotation winds drive cable 36 around cable drum 70, placing drive cable 36 in tension and pulling sliding window 18 along guide rails 20 to the open position to the left as viewed by FIG. 2. As drive cable 36 winds around cable drum 70, drive cable 38 simultaneously unwinds and so lengthens as sliding window 18 slides open. The motive force on window 18 is supplied exclusively by the tension in drive cable 36 as it is taken up by drum 70, with no significant force being transmitted by compression of drive cable 38.

When control switch 26 is actuated to close the window, motor 54 is energized to rotate in the opposite direction thereby driving cable drum 70 in the clockwise direction and shortening drive cable 38 while allowing drive cable 36 to lengthen. In this window closing actuation it is again a tensile force, this time applied to drive cable 38, which serves to move sliding window 18.

Because both opening and closing movements of sliding window 18 are caused by tension in drive cables 36 38 respectively, the tendency for the driving cable to bind within its conduit when under compression is eliminated. If a drive cable is put in compression to push window 18 closed, linear actuators 24 must, in order to prevent binding from occurring, be manufactured with less clearance between the outside diameter of drive cables 36, 38 and the inside diameter of conduits 32, 34. Such a cable requires more exact dimensional tolerances, and so is significantly more expensive to produce than a cable that need only transmit tensile forces.

An additional benefit of the pull/pull cable configuration is that motor 54 need not be as powerful as would be required if it had to overcome the binding inherent in the cable under compression. Motor power requirements are even further reduced by the elimination of the binding of window 18 in guide rails 20 that is caused by the tendency of the window to tip within the guide rails if the vector of the pushing force applied does not pass through the window center of mass.

Further, the high reduction ratio gear train constituted by worm gear 56, dual gear 58 and output gear 62 allows use of an electric motor that is much less powerful and less expensive than the motors heretofore commonly used in window regulators. The high reduction ratio gearing also provides enhanced vehicle security by making it all but impossible for a person to gain entry to the truck cab by forcing sliding window 18 to the open position against the drag of an deenergized motor.

If it is necessary for sliding window 18 to be moved manually, such as for example if drive unit 22 is inoperative, an occupant of the truck cab may easily detach drive cables 36, 38 from attachment blocks 48. This is accomplished by grasping the drive cable near attachment block 48, pulling on the drive cable to take up available slack, and lifting bead 50 out of slot 49.

Whereas preferred embodiments of the invention have been illustrated and described in detail, it will be apparent that many modifications and variations of the present invention are possible in light of the above teachings and the described embodiments are not intended to limit the scope of the present invention in any way.

We claim:

1. A power-driven sliding window assembly for an automotive vehicle wherein a window regulator mechanism moves a window along a substantially horizontal path between an open and a closed position, the window having a bottom edge retained along substantially its entire length in a lower guide rail and slidable linearly therein between the open and closed positions, the regulator mechanism comprising:

a drive unit comprising a reversible electric motor and a cable drum driven by the motor;

a first cable guide disposed adjacent a first end of the lower guide rail in substantially coplanar alignment with the window;

a second cable guide disposed adjacent a second end of the lower guide rail in substantially coplanar alignment with the window;

a first cable length having a first end connected to the window adjacent a first lower corner thereof and a second end engaging the cable drum, the first cable length extending from the cable drum to engage the first cable guide and extend therefrom along a first path substantially parallel with and above the lower guide rail to reach the window; and a second cable length having a first end connected to the window adjacent a second lower corner thereof and a second end engaging the cable drive drum, the second cable length extending from the cable drum to engage the second cable guide and extend therefrom along a second path substantially parallel with and above the lower guide rail to reach the window.

2. A sliding window assembly according to claim 1 wherein the first and second cable lengths each comprise a Bowden-type cable having a core wire and a conduit, the conduits extending between the drive unit and respective first and second cable guides.

3. A sliding window assembly according to claim 1 wherein the drive unit is securable to a portion of the automotive vehicle remote from the window unit and guide means.

4. A sliding window assembly according to claim 1 wherein the first and second cable lengths are connected to the window at points directly above the lower guide rail.

5. A sliding window assembly according to claim 1 wherein the first and second cable guides are connected directly to the lower guide rail.

6. A power-driven sliding window assembly for an automotive vehicle wherein a window regulator mechanism moves a window along a substantially horizontal path between an open and a closed position, the window having a bottom edge retained along substantially its entire length in a lower guide rail and slidable linearly therein between the open and closed positions, the regulator mechanism comprising:

a drive unit comprising a reversible electric motor and a cable drum driven by the motor;

a first cable guide disposed adjacent a first end of the lower guide rail;

a second cable guide disposed adjacent a second end of the lower guide rail;

a first cable length having a first end connected to the window adjacent a first lower corner thereof and a second end engaging the cable drum, the first cable length extending from the cable drum to engage the first cable guide and extend therefrom along a first path above the lower guide rail to reach the window; and a second cable length having a first end connected to the window adjacent a second lower corner thereof and a second end engaging the cable drive drum, the second cable length extending from the cable drum to engage the second cable guide and extend therefrom along a second path above the lower guide rail to reach the window;

the window, guide rail, cable guide means, and first and second paths all being disposed in substantially a single plane.

* * * * *

US005784833C1

(12) EX PARTE REEXAMINATION CERTIFICATE (5854th)

United States Patent
Sponable et al.

(10) Number: US 5,784,833 C1
(45) Certificate Issued: Aug. 14, 2007

(54) SLIDING WINDOW WITH MOTOR-DRIVEN REGULATOR

(75) Inventors: Edward Sponable, Novi, MI (US); Raymond Zeller, Westland, MI (US)

(73) Assignee: Hi-Lex Corporation, Battle Creek, MI (US)

Reexamination Request:
No. 90/007,484, Mar. 28, 2005

Reexamination Certificate for:

| | |
|---|---|
| Patent No.: | **5,784,833** |
| Issued: | **Jul. 28, 1998** |
| Appl. No.: | **08/696,657** |
| Filed: | **Aug. 14, 1996** |

(51) Int. Cl.

| | |
|---|---|
| ***E05F 15/14*** | (2006.01) |
| ***E05F 15/16*** | (2006.01) |
| ***E05F 11/48*** | (2006.01) |
| ***E05F 11/38*** | (2006.01) |

(52) U.S. Cl. ..... 49/360; 49/123; 49/361; 49/130

(58) Field of Classification Search ..... None
See application file for complete search history.

(56) References Cited

U.S. PATENT DOCUMENTS 4,793,099 A * 12/1988 Friese et al. ..... 49/380
5,724,769 A * 3/1998 Cripe et al. ..... 49/360

FOREIGN PATENT DOCUMENTS

JP 1-219280 * 9/1989

OTHER PUBLICATIONS

Letter dated May 17, 2005 from Steven L. Underwood to Thomas E. Bejin describing Mr. Underwood's assessment of Japanese reference Hei 1–219280.

* cited by examiner

*Primary Examiner*—Michael O'Neill

(57) ABSTRACT

A motor-driven window regulator for use with a horizontally sliding window installed in the rear window opening of a pickup truck cab. The sliding window is moved between a closed position wherein it fills a gap between two fixed, outboard mounted windows and an open position wherein it slides to overlap one of the fixed leaving the gap open. The sliding window is actuated by a pair of linear actuation cables, each of which is attached to the sliding window at a first end and to a motor-driven cable drive drum at a second end. The linear actuation cables extend away from the sliding window in opposite directions parallel with the direction of sliding movement and wrap around the cable drive drum in opposite directions so that rotation of the cable drive drum in one direction places a first cable in tension to pull the sliding window toward the open position and rotation of the cable drive drum in the opposite direction tensions the second cable to pull the sliding window toward the closed position. The pull/pull cable drive configuration results in the ability to use less closely toleranced and hence less expensive drive cables, as well as a motor which is smaller, less expensive and consumes less power.

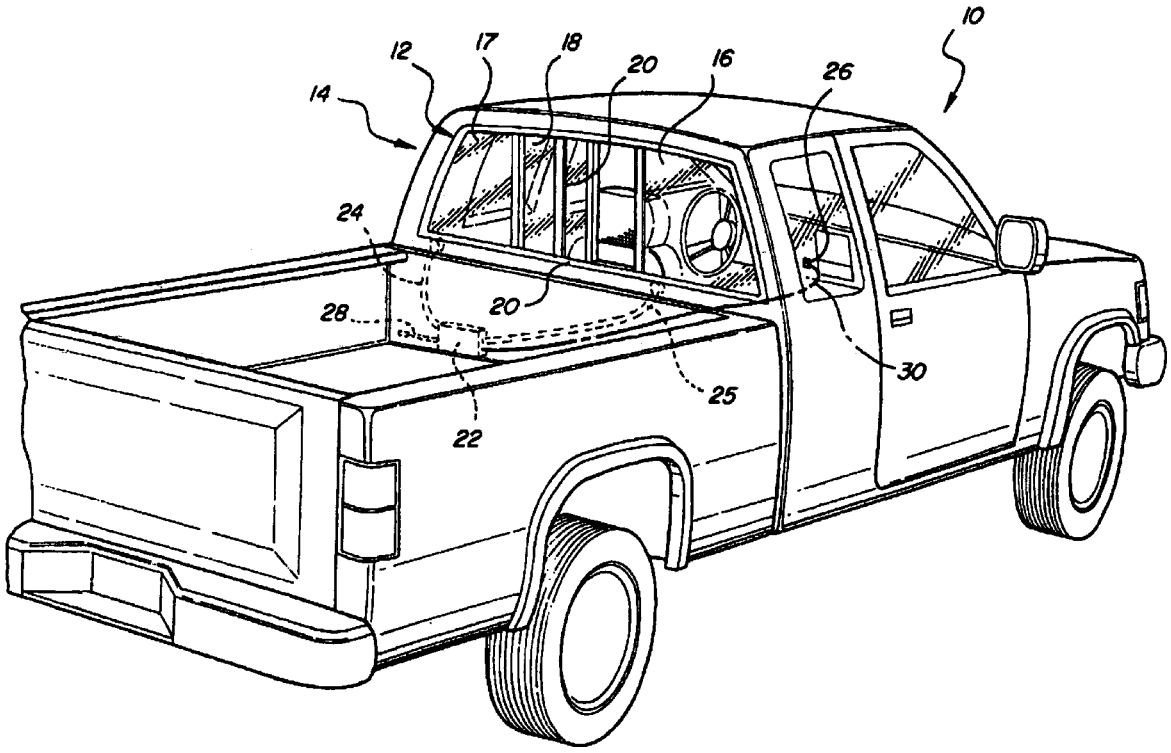

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *